US008941698B2

(12) United States Patent
Ha

(10) Patent No.: US 8,941,698 B2
(45) Date of Patent: Jan. 27, 2015

(54) LED ELECTRONIC SIGN BOARD CAPABLE OF POWER-SAVING PER PIXEL LINE

(71) Applicant: Dong Bang Data Technology Co. Ltd., Seoul (KR)

(72) Inventor: Young-Jae Ha, Gyeonggi-do (KR)

(73) Assignee: Dong Bang Data Technology Co., Ltd., Seoul (KR)

( * ) Notice: Subject to any disclaimer, the term of this patent is extended or adjusted under 35 U.S.C. 154(b) by 184 days.

(21) Appl. No.: 13/644,173

(22) Filed: Oct. 3, 2012

(65) Prior Publication Data

US 2013/0271514 A1 Oct. 17, 2013

(30) Foreign Application Priority Data

Oct. 4, 2011 (KR) ..... 10-2011-0100445

(51) Int. Cl.

| | |
|---|---|
| ***G09G 5/02*** | (2006.01) |
| *G09G 3/14* | (2006.01) |
| *G09G 3/32* | (2006.01) |
| *G08B 5/22* | (2006.01) |

(52) U.S. Cl.

CPC ..... *G09G 3/32* (2013.01); *G09G 2330/022* (2013.01); *G09G 2330/028* (2013.01)

USPC ..... 345/694; 345/39; 345/82; 340/815.45

(58) Field of Classification Search

CPC ..... G09G 2300/0452

USPC ..... 345/694

See application file for complete search history.

(56) References Cited

U.S. PATENT DOCUMENTS

| | | | | |
|---|---|---|---|---|
| 6,798,906 | B1 * | 9/2004 | Kato | 382/176 |
| 2006/0115291 | A1 * | 6/2006 | Chung | 399/90 |
| 2011/0032696 | A1 * | 2/2011 | Kim et al. | 362/184 |

FOREIGN PATENT DOCUMENTS

| | | | |
|---|---|---|---|
| JP | 200272946 | A | 3/2002 |
| JP | 2003316315 | A | 11/2003 |

* cited by examiner

*Primary Examiner* — Kent Chang
*Assistant Examiner* — Chayce Bibbee
(74) *Attorney, Agent, or Firm* — Haverstock & Owens LLP

(57) ABSTRACT

The invention relates to an LED electronic sign board capable of power-saving per pixel line, comprising: an LED display panel; a panel driver; a switching mode power supply that receives AC power, generates driving power required to operate the LED display panel and the panel driver and supplies power to the LED display panel and the panel driver; a black line extractor that analyzes an image signal which will be displayed on the LED display panel and extracts pixel lines which becomes black per LED module; and a main controller that controls the panel driver to display an image on the LED display panel according to the image signal, and that controls a switching signal for the operation of the switching mode power supply to shut off driving power that is supplied to the pixel lines extracted by the black line extractor from the switching mode power supply.

1 Claim, 8 Drawing Sheets

LED ELECTRONIC SIGN BOARD CAPABLE OF POWER-SAVING PER PIXEL LINE

TECHNICAL FIELD

The invention relates to an LED electronic sign board capable of power-saving per pixel line, and in particular an LED electronic sign board capable of shutting off driving power per pixel line of a plurality of LED modules constituting an LED display panel by controlling a switching signal of a switching mode power supply (SMPS) which supplies driving power to an LED display panel and a panel driver, thereby minimizing energy consumption.

BACKGROUND

LED stands for a semi-conductor element, i.e., a Light Emitting Diode and is being used for an electronic screen for various electronic devices which displays various colors such as red, green, blue, yellow, etc.

An LED electronic sign board has a plurality of LEDs in a matrix which constitute pixels to display various images. Various LED electronic sign boards are installed inside or outside of the building for the advertisement or the delivery of information.

Recently, LED electronic sign board is widely being used for the display of moving image such as TV commercial as well as the display of simple texts or still images and becomes bigger, which causes the increase of electric power consumed on the LED electronic sign board. Considering that power saving technology is becoming increasingly common in the industry, it is required to reduce electric power consumed on the LED electronic sign board.

DISCLOSURE

Technical Problem

To reduce power consumed by LED electronic sign board, it may be suggested to shut off a commercial AC power source for the LED electronic sign board itself when the LED electronic sign board is not in use. In reality, however, the shut-off is applied only when the LED electronic sign board is not in use for a long time because the shut-off may cause damage to a circuit. Therefore, it is barely possible to shut off a commercial AC power source in real time whenever necessary.

To solve the above problem, the invention provides an LED electronic sign board capable of power-saving per pixel line to shut off driving power per pixel line of a plurality of LED modules constituting an LED display panel by controlling a switching signal of a switching mode power supply (SMPS) which supplies driving power to an LED display panel and a panel driver, thereby minimizing energy consumption.

Technical Solution

The purpose of the invention is achieved by an LED electronic sign board capable of power-saving per pixel line, comprising: an LED display panel comprising a plurality of LED modules arranged in a matrix to form a screen, wherein each LED module includes a predetermined number of LEDs; a panel driver comprising a plurality of module drivers to drive the LED modules, respectively, wherein each module driver corresponds to each LED module to display an image on each LED module; a switching mode power supply which receives AC power, generates driving power required to operate the LED display panel and the panel driver and supplies power to the LED display panel and the panel driver; a black line extractor which analyses an image signal which will be displayed on the LED display panel and extracts pixel lines which becomes black per LED module; and a main controller which controls the panel driver to display an image on the LED display panel according to the image signal, and which controls a switching signal for the operation of the switching mode power supply to shut off driving power which is supplied to the pixel lines extracted by the black line extractor from the switching mode power supply.

Further, the switching mode power supply comprises a plurality of individual SMPS units which supplies driving power to at least one of the plurality of LED modules and at least one of the plurality of module drivers, respectively; each individual SMPS unit comprises a plurality of line power supply units which supply driving power to each pixel line of the LED module per pixel line; each line power supply unit comprises an input rectifier circuit which rectifies AC power, a switching circuit which switches the power rectified by the input rectifier circuit and generates a square wave, a output rectifier circuit which receives and rectifies the square wave from the switching circuit and generates driving power, and a switching controller which controls switching operation of the switching circuit; and the main controller controls the switching controller to stop the output of the square wave of the switching circuit by controlling a switching signal of the switching controller, whereby driving power which is supplied to the pixel line extracted by the black line extractor being shut off.

Advantageous Effects

According the invention, an LED electronic sign board capable of power-saving per pixel line is provided to shut off driving power per pixel line of a plurality of LED modules constituting an LED display panel by controlling a switching signal of a switching mode power supply (SMPS) which supplies driving power to an LED display panel and a panel driver, thereby minimizing energy consumption.

MODE FOR INVENTION

Hereinafter, the invention will be described in more detail, referring to the attached drawings.

Figure 1:
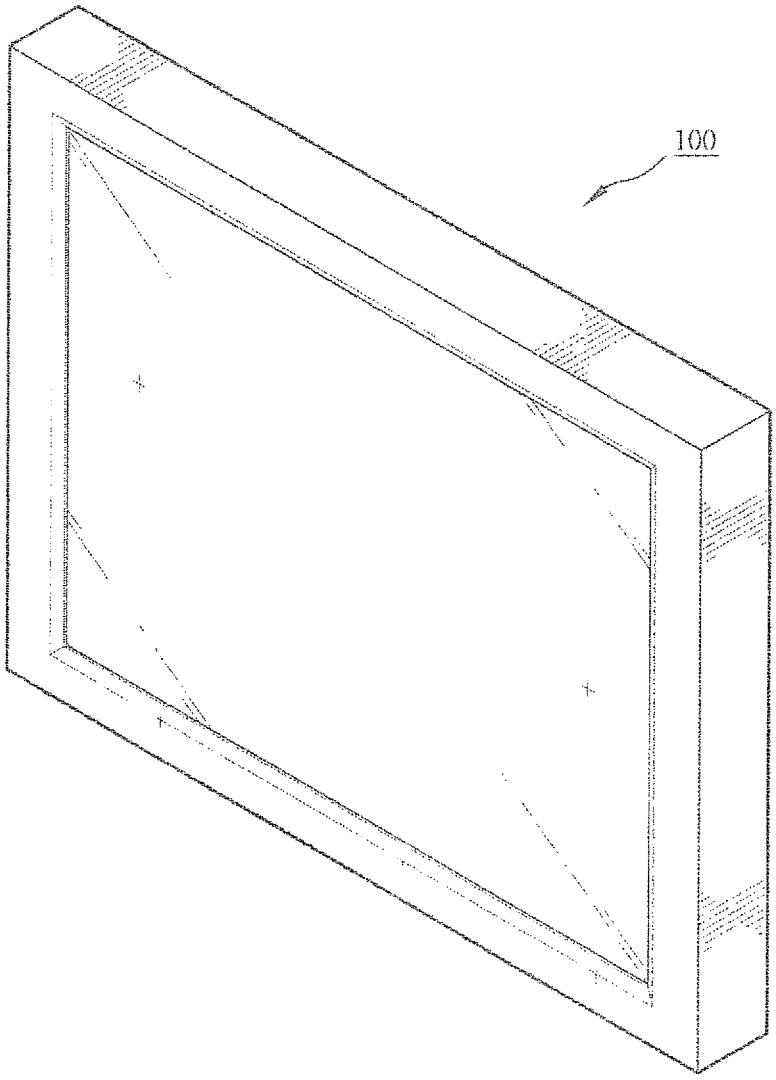
FIG. 1 represents a perspective view of a power-saving LED electronic sign board according to the present invention.
Figure 2:
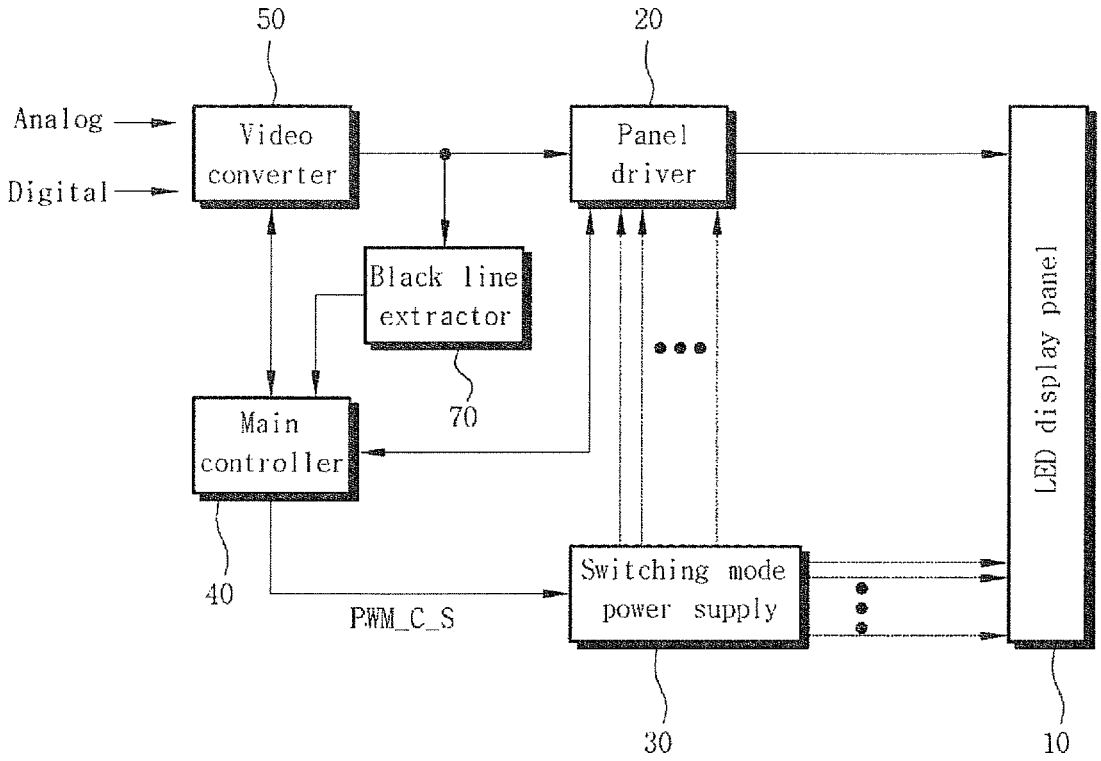
FIG. 2 represents a control block diagram of an LED electronic sign board according to the present invention.

FIG. 1 shows a perspective view of a power-saving LED electronic sign board 100 and FIG. 2 represents a control block diagram of the LED electronic sign board 100. As shown in FIGS. 1 and 2, the LED electronic sign board 100 comprises an LED display panel 10, a panel driver 20, a video converter 50, a switching mode power supply 30, a black line extractor 70 and a main controller 40.

The video converter 50 converts an image signal which is received from the outside into a digital-formatted image signal capable of being processed by the panel driver 20. In this regard, the video converter 50 comprises an A/D converter which converts an analog image signal into a digital-formatted signal, and a DVI decoder to process a digital-formatted image signal. Also, the video converter 50 comprises a video correction unit which corrects a digital image signal by means of a preset image correction algorithm. Alternatively, the video converter may be implemented in various forms which are already known in the field of the art.

The LED display panel 10 comprises a plurality of LEDs to form a screen and displays an image on a screen by the operation of a panel driver 20. The display panel 10 is configured such that one pixel includes at least two LEDs. In one example, the display panel is configured such that a red LED, a green LED and a blue LED constitute one pixel (full-color type), or such that a red LED and a green LED constitute one pixel (3-color type).

The LED display panel 10 forms a screen in such a manner that a predetermined number of LEDs are arranged to constitute LED module 10*a*, 10*b* and 10*c* and a plurality of LED modules are arranged in a matrix form. In one example, one LED module 10*a*, 10*b* and 10*c* is made of 16×16 pixels and a plurality of LED modules 10*a*, 10*b* and 10*c* are arranged in a matrix form to form a full screen of LED display panel 10.

Figure 3:
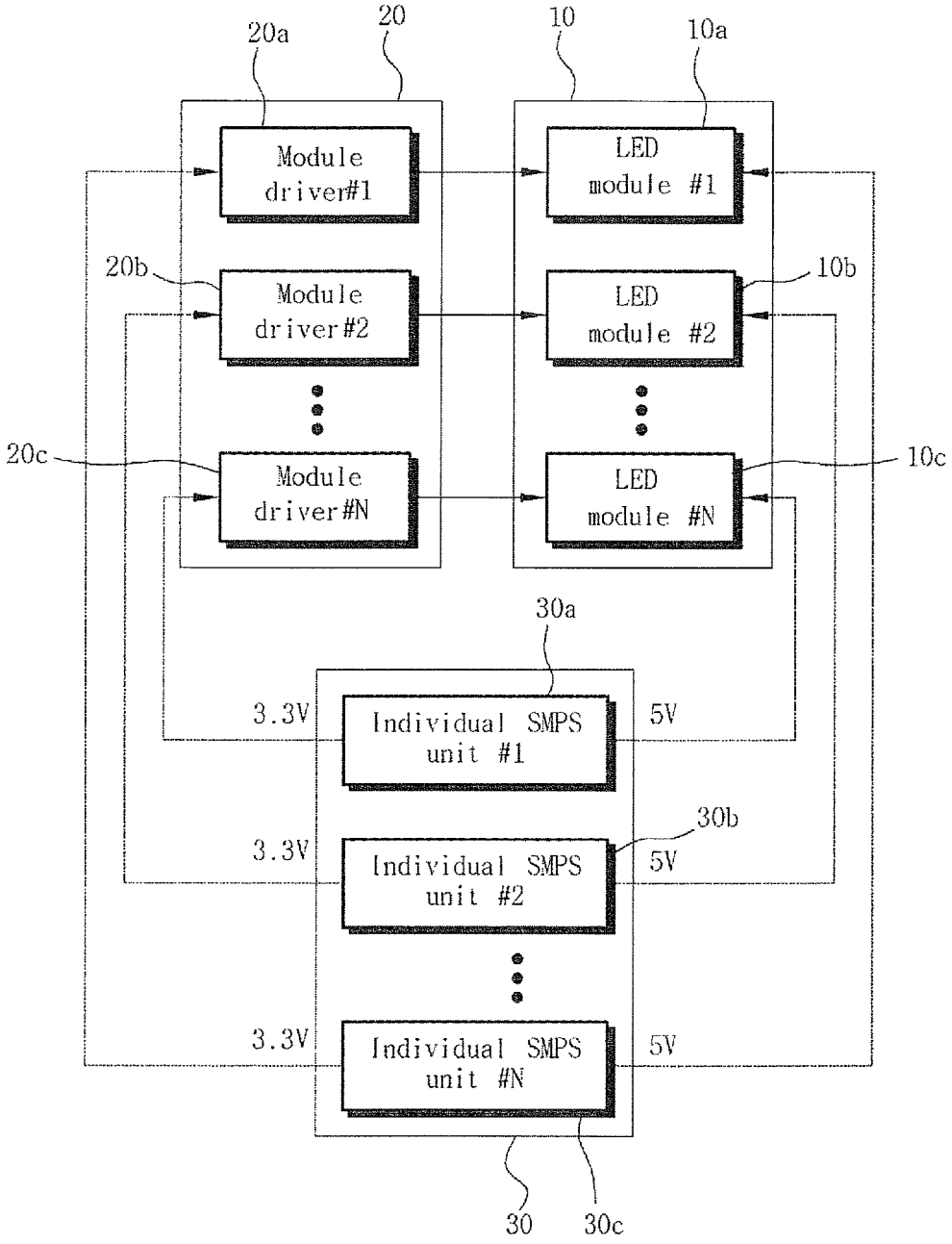
FIG. 3 represents an example of an LED display panel of an LED electronic sign board, a panel driver, a switching mode power supply according to the present invention.

The panel driver 20 drives the LED display panel 10 to display an image on the LED display panel 10 by using digital image signals from the video converter 50. As shown in FIG. 3, the panel driver 20 according to the invention comprises a plurality of module drivers 20*a*, 20*b* and 20*c* which are configured to correspond to each LED module 10*a*, 10*b* and 10*c* and which drive LED modules 10*a*, 10*b* and 10*c*, respectively to display an image on each LED module 10*a*, 10*b* and 10*c*. The main controller 40 controls LED modules 10*a*, 10*b* and 10*c*, respectively according to digital image signals from video converter 50 such that images on each LED module 10*a*, 10*b* and 10*c* are combined for the display of a full image.

The switching mode power supply 30 receives a commercial AC power, generates driving power required to drive the LED display panel 10 and the LED modules 10*a*, 10*b* and 10*c* and then supplies the power to the display panel 10 and the panel driver 20. The switching mode power supply 30 provides the LED display panel 10 and the panel driver 20 with DC power having a preset voltage level which is switched according to PWM (pulse width modulation) signals.

As shown in FIG. 3, the switching mode power supply 30 comprises a plurality of individual SMPS units 30*a*, 30*b* and 30*c*. Each individual SMPS unit 30*a*, 30*b* and 30*c* is provided to supply driving power to each LED module 10*a*, 10*b* and 10*c* and each module driver 20*a*, 20*b* and 20*c* which drives an associated LED module 10*a*, 10*b* and 10*c*. Therefore, when the output from driving power source of one individual SMPS unit 30*a*, 30*b* and 30*c* is stopped, one LED module 10*a*, 10*b* and 10*c* and one module driver 20*a*, 20*b* and 20*c* which drives the LED module are disconnected with the driving power source.

The black line extractor 70 extracts a pixel line which will be displayed black per LED module 20*a*, 20*b* and 20*c* by analyzing an image signal to be sent to the LED display panel 10. FIG. 2 is an example showing that pixel lines which will be displayed black are extracted from an image signal transferred from the video converter 50 to the panel driver 20. Alternatively, the pixel line which will be displayed black may be extracted during a signal processing in the video converter 50 or during a signal processing in the panel driver 20.

The main controller 40 controls the panel driver 20 such that an image is displayed on the LED display panel 10 according to the image signal. Also, the main controller 40 controls a switching signal of the switching mode power supply 30 to shut off driving power transferred from the switching mode power supply to the pixel line extracted by the black line extractor 70.

Figure 4:
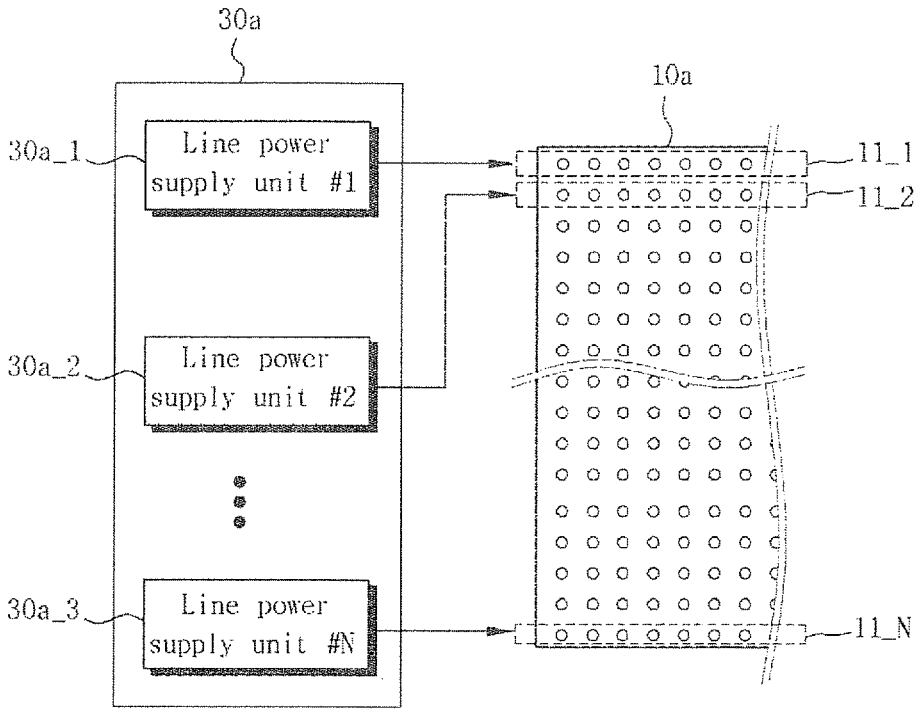
FIGS. 4 to 6 represent an operation of an individual SMPS unit according to the present invention.
Figure 5:
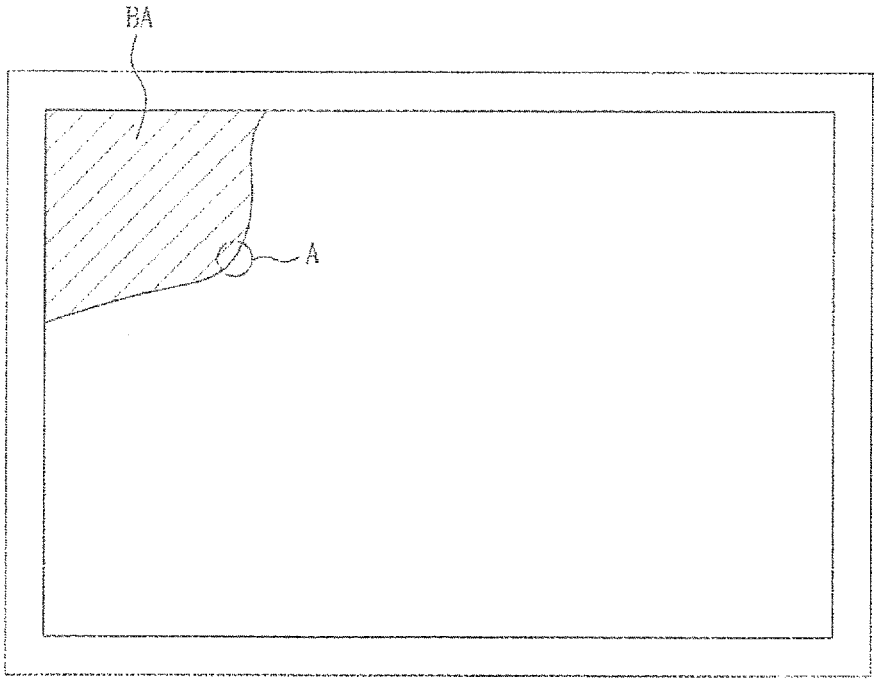
Figure 6:
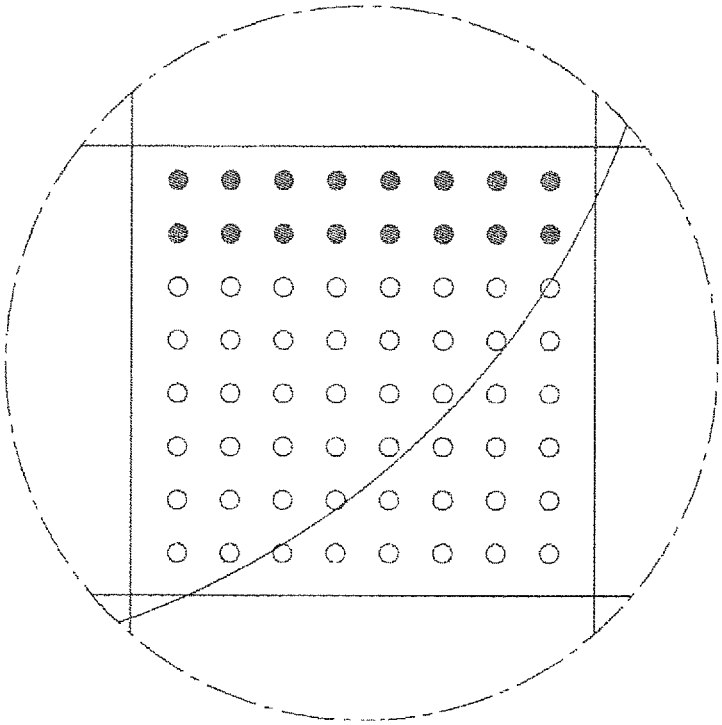

Referring to FIGS. 4 to 6, each individual SMPS unit 30*a*, 30*b* and 30*c* comprises a plurality of line power supply units 30*a*_1, 30*a*_2 and 30*a*_3 which supply driving power to pixel lines 11_1, 11_2 and 11_N, respectively and each line power supply unit is configured to correspond to each pixel line of the LED module 10*a*, 10*b* and 10*c*.

The main controller 40 controls a switching signal of the line power supply unit 30*a*_1, 30*a*_2 and 30*a*_3 which supplies driving power to corresponding pixel line 11_1, 11_2 and 11_N to shut off driving power which is supplied to pixel lines 11_1, 11_2 and 11_N corresponding to pixel lines 11_1, 11_2 and 11_N extracted by the black line extractor 70.

Referring to FIG. 5, in case that there is a black area (BA) which is displayed black on a screen, if one LED module 10*a*, 10*b* and 10*c* is within the black area (BA), the main controller 40 controls switching signals of the line power supply units 30*a*_1, 30*a*_2 and 30*a*_3 of the corresponding individual SMPS unit 30*a*, 30*b*, 30*c* such that driving power supplied to the entire pixel lines 11_1, 11_2 and 11_N of the corresponding LED module 10*a*, 10*b* and 10*c* is shut off. Specifically, switching signals are controlled to shut off driving power supplied from all line power supply units 30*a*_1, 30*a*_2 and 30*a*_3.

As shown in an A area of FIG. 5, in case that only some pixel lines (see the black pixel lines in FIG. 6) of the pixel lines 11_1, 11_2 and 11_N of one LED module 10*a*, 10*b* and 10*c* are displayed black, the main controller 40 controls switching signals of the corresponding line power supply units 30*a*_1, 30*a*_2 and 30*a*_3 such that driving power supplied to the corresponding pixel lines 11_1, 11_2 and 11_N is shut off.

Figure 7:
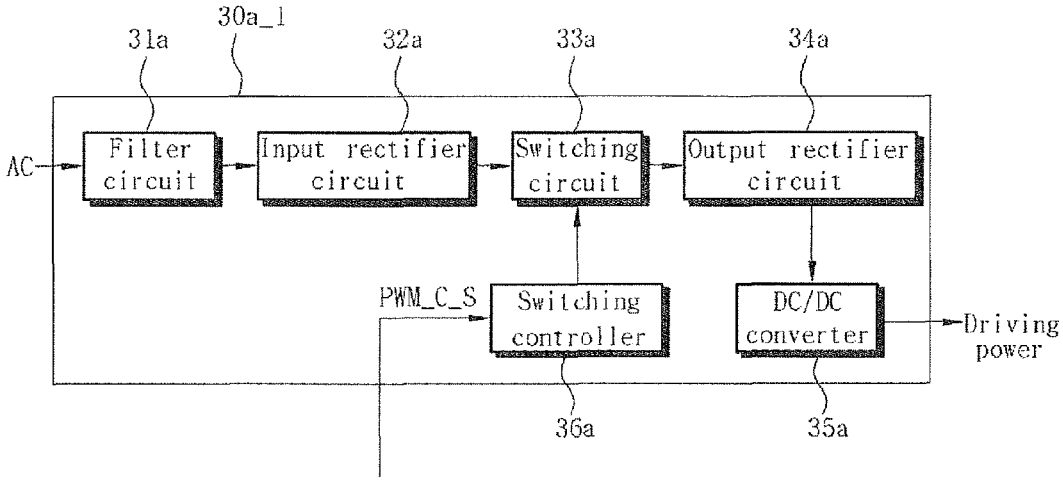
FIG. 7 represents an example of a line power supply unit according to the present invention.

FIG. 7 represents an example of a line power supply unit 30*a*_1, 30*a*_2 and 30*a*_3 according to the invention. As shown in FIG. 7, the line power supply unit 30*a*_1, 30*a*_2 and 30*a*_3 according to the invention comprises a filter circuit 31*a*, an input rectifier circuit 32*a*, a switching circuit 33*a*, an output rectifier circuit 34*a*, a DC/DC converter 35*a* and a switching controller 36*a*.

The input rectifier circuit 32*a* rectifies AC power which is input thereto. The input rectifier circuit 32*a* comprises a full-wave bridge diode and a condenser, and rectifies AC power, e.g., 220V AC power and generates 300V DC voltage having a ripple.

The switching circuit 33*a* generates a square wave by switching DC power which is generated by the rectification of the input rectifier circuit 32*a*. The switching circuit 33*a* consists of a switching element such as Field Effect Transistor (FET), and generates a square wave by switching DC power which is generated from the input rectifier circuit 32*a*.

The output rectifier circuit 34*a* generates DC voltage by rectifying a square wave from the switching circuit 33*a*. Then, DC/DC converter 35*a* controls a voltage level of DC voltage from the output rectifier circuit 34*a* and then generates driving power having a voltage level to drive the LED module 10*a*, 10*b* and 10*c* and driving power having a voltage level to drive the module driver 20*a*, 20*b* and 20*c*.

The switching controller 36*a* controls a switching operation of the switching circuit 33*a* such that the switching circuit 33*a* generates a square wave. The switching controller 36*a* controls the switching circuit 33*a* by a PWM control which controls the switching circuit 33*a* by means of PWM signals.

The main controller 40 sends a control signal (PWM_C_S) to the switching controller 36*a* of the line power supply unit 30*a*_1, 30*a*_2 and 30*a*_3 such that the switching controller 36*a* controls a switching operation of the switching circuit 33*a*. The switching controller 36*a* controls a switching signal, i.e., a PWM signal which is sent to the switching circuit 33*a* so as to stop the output of a square wave of the switching circuit 33*a*.

Figure 8:
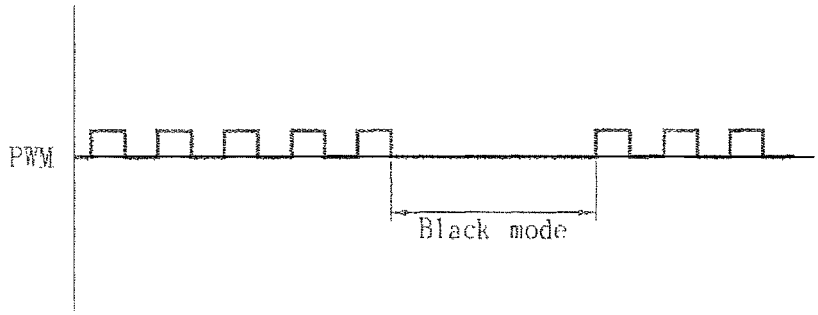
FIG. 8 represents an example of PWM signal which is transferred from a switching controller of the line power supply unit of FIG. 7 to a switching circuit.

FIG. 8 represents an example of a PWM signal which is sent from the switching controller 36*a* to the switching circuit 33*a* and describes that the switching controller 36*a* generates a PWM signal in the form of a pulse wave for the generation of driving power, and when a control signal (PWM_C_S) is received from the main controller 40, then converts the PWM signal into LOW state so as to stop off the output of a square wave.

As described above, the main controller 40 controls a switching signal of the switching mode power supply 30 such that driving power supplied to a plurality of pixel lines 11_1, 11_2, 11_N of each LED module 10*a*, 10*b* and 10*c* in the LED display panel 10 is made ON/OFF selectively. Therefore, the ON/OFF switching is made possible with no damage to the circuit.

Therefore, by shutting off the black area (BA) which displays black image on the LED electronic sign board 100 according to the invention per pixel line 11_1, 11_2, 11_N, it is possible to shut off wasting power stably.

Further, a switching signal, i.e., a PWM signal, itself is changed into LOW state to stop the output of the driving power itself, thereby eliminating power loss which a black-process causes in a state of driving power being connected like the conventional devices.

It is intended that the foregoing description has described only a few of the many possible implementations of the present invention, and that variations or modifications of the embodiments apparent to those skilled in the art are embraced within the scope and spirit of the invention.

| [List of Reference Number] | |
|---|---|
| 100: power-saving LED electronic sign board | 10: LED display panel |
| 10a, 10b, 10c: LED module | 30: switching mode power supply |
| 30a, 30b, 30c: individual SMPS unit | |
| 30a_1, 30a_2, 30a_3: line power supply unit | |
| 40: main controller | |
| 50: video converter | |
| 70: black line extractor | |

The invention claimed is:

1. An LED electronic sign board capable of power-saving per pixel line, comprising:

an LED display panel comprising a plurality of LED modules arranged in a matrix to form a screen, wherein each LED module includes a predetermined number of LEDs;

a panel driver comprising a plurality of module drivers to drive the LED modules, respectively, wherein each module driver corresponds to each LED module to display an image on each LED module;

a switching mode power supply that receives AC power, generates driving power required to operate the LED display panel and the panel driver and supplies power to the LED display panel and the panel driver;

a black line extractor that analyses an image signal which will be displayed on the LED display panel and extracts pixel lines which becomes black per LED module; and a main controller that controls the panel driver to display an image on the LED display panel according to the image signal, and that controls a switching signal for the operation of the switching mode power supply to shut off driving power that is supplied to the pixel lines extracted by the black line extractor from the switching mode power supply, wherein the switching mode power supply comprises a plurality of individual SMPS units that supplies driving power to at least one of the plurality of LED modules and at least one of the plurality of module drivers, respectively;

wherein each individual SMPS unit comprises a plurality of line power supply units that supplies driving power to each pixel line of the LED module per pixel line;

wherein each line power supply unit comprises an input rectifier circuit that rectifies AC power, a switching circuit that switches the power rectified by the input rectifier circuit and generates a square wave, a output rectifier circuit that receives and rectifies the square wave from the switching circuit and generates driving power, and a switching controller that controls switching operation of the switching circuit; and wherein the main controller controls the switching controller to stop the output of the square wave of the switching circuit by controlling a switching signal of the switching controller, whereby driving power which is supplied to the pixel line extracted by the black line extractor being shut off.

* * * * *